US006029416A

United States Patent [19]

Andersson

[11] Patent Number: 6,029,416

[45] Date of Patent: Feb. 29, 2000

[54] JOINTING SYSTEM

[75] Inventor: Kjell Andersson, Anderstorp, Sweden

[73] Assignee: Golvabia AB, Anderstorp, Sweden

[21] Appl. No.: 08/875,270

[22] PCT Filed: Dec. 19, 1995

[86] PCT No.: PCT/SE96/01537

§ 371 Date: Jul. 18, 1997

§ 102(e) Date: Jul. 18, 1997

[87] PCT Pub. No.: WO96/23942

PCT Pub. Date: Aug. 8, 1996

[30] Foreign Application Priority Data

Jan. 30, 1995 [SE] Sweden ..... 9500318

[51] Int. Cl.[7] ..... E04B 5/00

[52] U.S. Cl. ..... 52/592.1; 52/392; 52/403.1; 403/354

[58] Field of Search ..... 52/392, 403.1, 52/480, 592.1, DIG. 13; 403/354

[56] References Cited

U.S. PATENT DOCUMENTS

| | | | |
|---|---|---|---|
| 1,864,774 | 6/1932 | Storm | 52/403.1 |
| 2,900,676 | 8/1959 | Kahr | 52/592.1 |
| 3,777,435 | 12/1973 | Perina | 52/DIG. 13 |
| 4,271,566 | 6/1981 | Perina | 52/DIG. 13 |
| 4,879,854 | 11/1989 | Handler | 52/DIG. 13 |
| 5,362,560 | 11/1994 | Ehrhart et al. | 52/392 X |
| 5,618,602 | 4/1997 | Nelson | 52/592.1 X |
| 5,678,369 | 10/1997 | Ishikawa et al. | 52/592.1 X |

*Primary Examiner*—Carl D. Friedman
*Assistant Examiner*—Timothy B. Kang
*Attorney, Agent, or Firm*—Smith, Gambrell & Russell, LLP

[57] ABSTRACT

In a system for jointing together of adjacent pieces of flooring material by means of grooves (3) and tongues (4), at least one of the opposing surfaces on the tongues (4) and the grooves (3) of the pieces display flocked surface portions (10–13). The flocked surface portions (10–13) extend along the tongues (4) and/or the grooves (3) and cover substantially their entire length. The fiber length (9) of the flocked surface portions (10–13) exceeds the difference between the width of the grooves (3) and the thickness of the tongues (4).

27 Claims, 3 Drawing Sheets

JOINTING SYSTEM

TECHNICAL FIELD

The present invention relates to a system for tongue and groove jointing of adjacent pieces of flooring material.

The present invention also relates to a flooring material which is composed of a number of smaller pieces provided with tongues and grooves.

BACKGROUND ART

Flooring materials of the parquet floor type are previously known in the art as displaying surface coatings of, for example, veneer, laminate or the like on the upper and lower sides. The flooring material is in the form of tiles or elongate, relatively narrow strips which, in the central region seen in the cross sectional direction, have a panel or core forming layer often of wood or wood-based materials such as coreboard, hardboard, chipboard, MDF board (medium density fiber board) or the like.

Along their edges, the pieces of such flooring material are provided with tongues and grooves (T&G) which are joined together when a floor is laid. In order to positionally fix the different pieces of the flooring material, glue is employed to a large extent, so that a large continuous sheet is formed of the flooring material which thereby covers a complete floor in one continuous unbroken piece or stratum.

The use of glue for jointing together smaller pieces of flooring material is time-consuming and involves risks that the surface coating layers, principally on the upper side of the material, be dirtied so that they become unusable or at least require cleaning.

PROBLEM STRUCTURE

The present invention has for its object to devise the system intimated by way of introduction such that it obviates the drawbacks inherent in older, prior art designs and constructions. In particular, the present invention has for its object to realise a system which eliminates the need for glue in jointing together of T&G on adjacent pieces of flooring material. Thus, the present invention relates to a system which permits adjacent pieces of flooring material quite simply to be slid together in order thereafter to be separable from one another only with great difficulty or using force. Finally, the present invention has for its object to realise a system which is simple and economical to produce.

SOLUTION

The objects forming the basis of the present invention will be attained if the system intimated by way of introduction is characterized in that at least one of the opposing surfaces on the tongues and grooves of the flooring pieces are provided with flocked surface portions.

The flocked surface portions display such length of individual fibers that these are bent on jointing together of two adjacent pieces of flooring material. The thus bent or curved fibers will hereby act as a very large number of barbs which must be bent or deformed in connection with the separation of the flooring material pieces from one another. Taken as a whole, these fibers generate extremely great cohesive forces.

Further advantages will be attained if the present invention is also given one or more of the characterizing features as set forth in appended claims 2 to 10.

BRIEF DESCRIPTION OF THE ACCOMPANYING DRAWINGS

The present invention will now be described in greater detail hereinbelow, with particular reference to the accompanying Drawings. In the accompanying Drawings.

DESCRIPTION OF PREFERRED EMBODIMENTS

Figure 1:
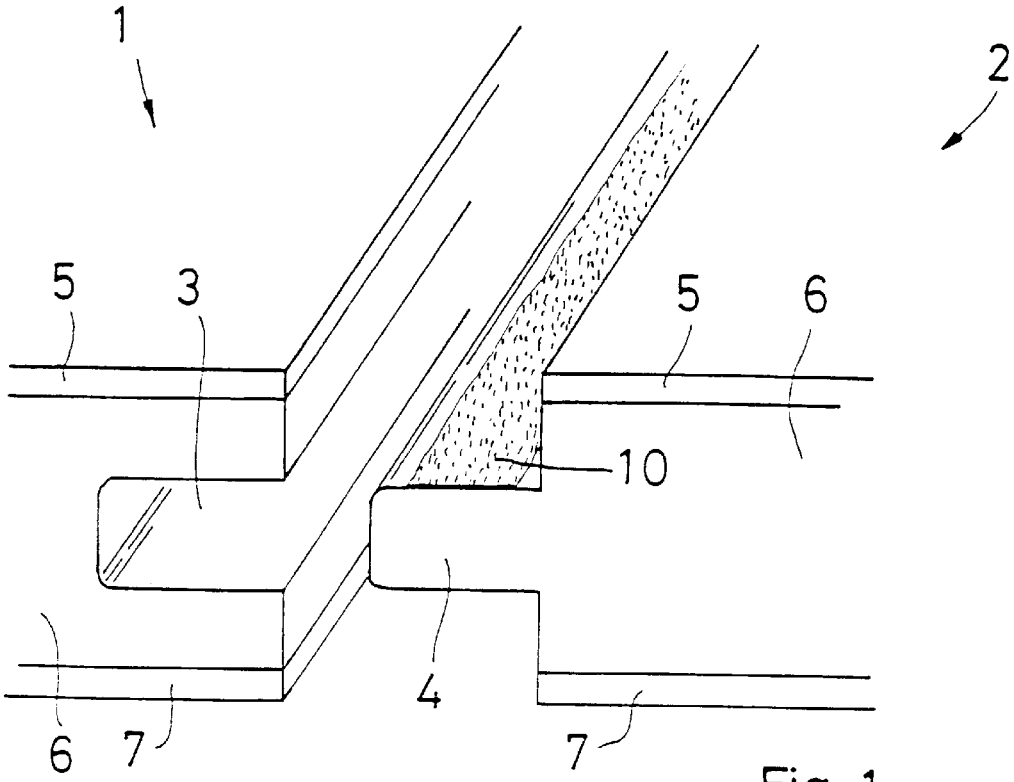
FIG. 1 is a perspective partial view of a first embodiment of the present invention.
Figure 6:
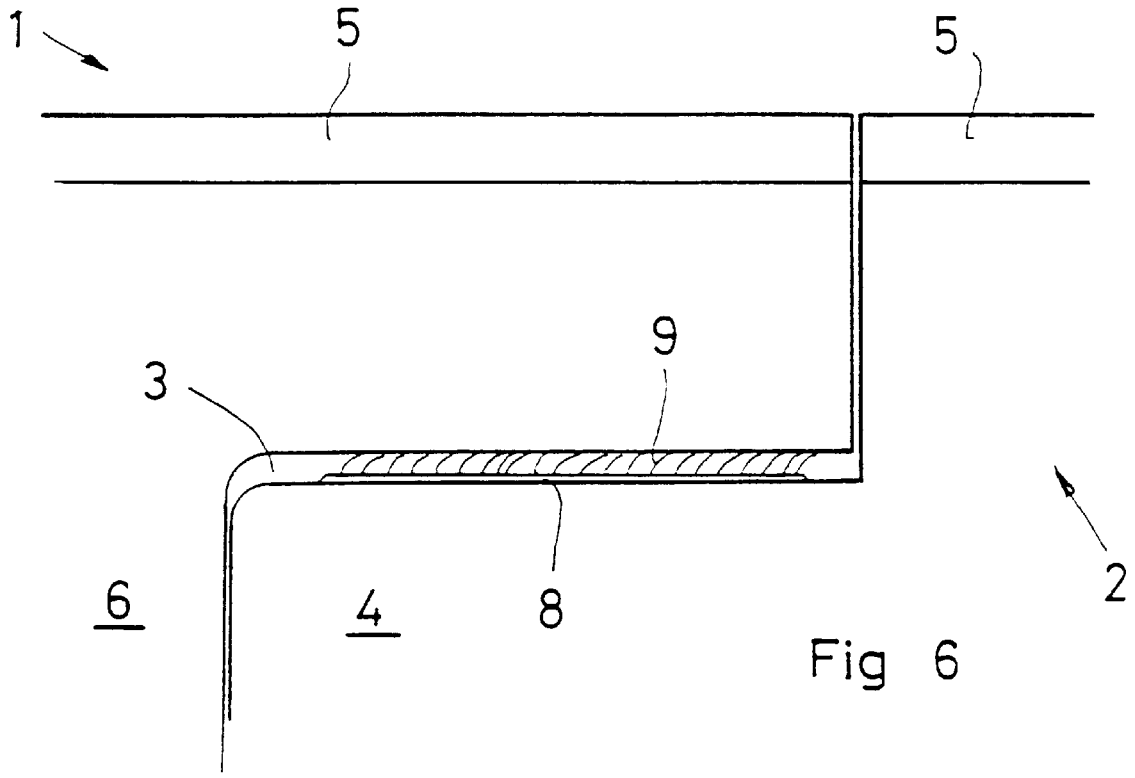
FIG. 6 is a partial view, on a larger scale, of a jointing region between a groove and a tongue accommodated therein.

In FIG. 1, reference numerals 1 and 2 relate to two pieces of a flooring material in which a first piece 1 is provided with a groove 3 for jointing together with a corresponding tongue 4 on the other flooring piece 2. The different pieces of flooring material which, in daily parlance, are often called "laminated parquet", have upper surface coating layers 5 which, on the one hand, are intended to be of decorative appearance in order, for example, to imitate a "genuine" parquet floor and, on the other hand, possess good resistance to wear etc. Seen in the cross sectional direction centrally in the pieces 1 and 2, these have cores 6 or panel forming portions which preferably consist of wood or wood-based material. For example, the cores may consist of coreboard, plywood, hardboard, chipboard, MDF board (medium density fiber board) or similar material. Finally, the pieces 1 and 2 have, on their underside, a lower surface coating 7 whose function is to act as a barrier layer preventing the flooring material from warping as a result of damp, temperature differences or other factors. Thus, the purpose of the barrier layer 7 is to keep the pieces of flooring material in a planar state. As far as the flooring material and the pieces thereof are described above, they are to be considered as conventional In its most general form, the present invention implies that at least one of the counter-facing surfaces on the tongues 4 and grooves 3 of the pieces 1 and 2 are provided with a large number of barb devices. These barb devices are designed in such a manner that, on jointing together of tongue and groove, they are folded or bent obliquely backwards in the direction of insertion of the tongue 4 into the groove 3 in order to engage with an opposing surface on the other material piece (FIG. 6). In order to be able to separate the material pieces 1 and 2 from one another, i.e. by withdrawing the tongue 4 from the groove 3, it is necessary that these barb devices be considerably deformed, substantially in their own longitudinal direction, or that they be forced into the opposing surface on the other material piece. If the barb devices are present in large numbers, extremely great forces may occur which prevent withdrawal of the tongue 4.

In one practical embodiment, the barb devices are formed from so-called flocks which are applied according to the foregoing and which extend in the longitudinal direction of the tongues and/or the grooves and cover substantially the whole of their length.

A flock consists of a base 8 (FIG. 6) in the form of a layer or foil of suitable adhesive or binder in which the one end of a very large number of approximately equal-length fibers 9 (FIG. 6) are secured. The individual fibers are straight and at least transversely directed, but preferably approximately at right angles to the plane of the base and the subjacent surface.

The application of the base 8 may be effected by spraying, brushing or the like of a binder of suitable viscosity. Thereafter, the electrostatically charged short fiber pieces are blown or sprayed against the binder layer so that the ends of the individual fibers adhere in the base. As a result of the electrostatic charging with the same polarity on all fibers, the fibers will repel one another and assume a position such that they will be approximately at right angles to the substrate.

It will further be apparent from FIG. 6 that the fiber length, or at least the average fiber length, exceeds the difference between the width of the grooves and the thickness of the tongues. This ensures the above-mentioned bending and oblique positioning of the fibers 9 on insertion of the tongue 4 in the groove 3.

In order to improve the capability of the barb devices or individual fibres 9 to engage with the opposing surface, this is provided with a roughened, raised or uneven surface structure. If the core 6 in the pieces 1 and 2 consists of wood or wood-based material, a suitable surface structure may be achieved by direct machine processing of this material. A suitable surface structure will thus be created by sawing, milling or grinding direct in the material of the core 6.

In the embodiment according to FIG. 1, there is provided an elongate, strip shaped flock 10 on the upper side of the tongue 4. The flock 10 extends suitably along the tongue 4 preferably throughout its entire length. Furthermore, it is appropriate that the flock 10 covers as great a portion of the width of the tongue as possible.

The application of the flock 10 to the tongue 4 is particularly simple, since the upper and lower surfaces of the tongue 4 are freely accessible for the electrostatic application of the fibers 9.

Figure 2:
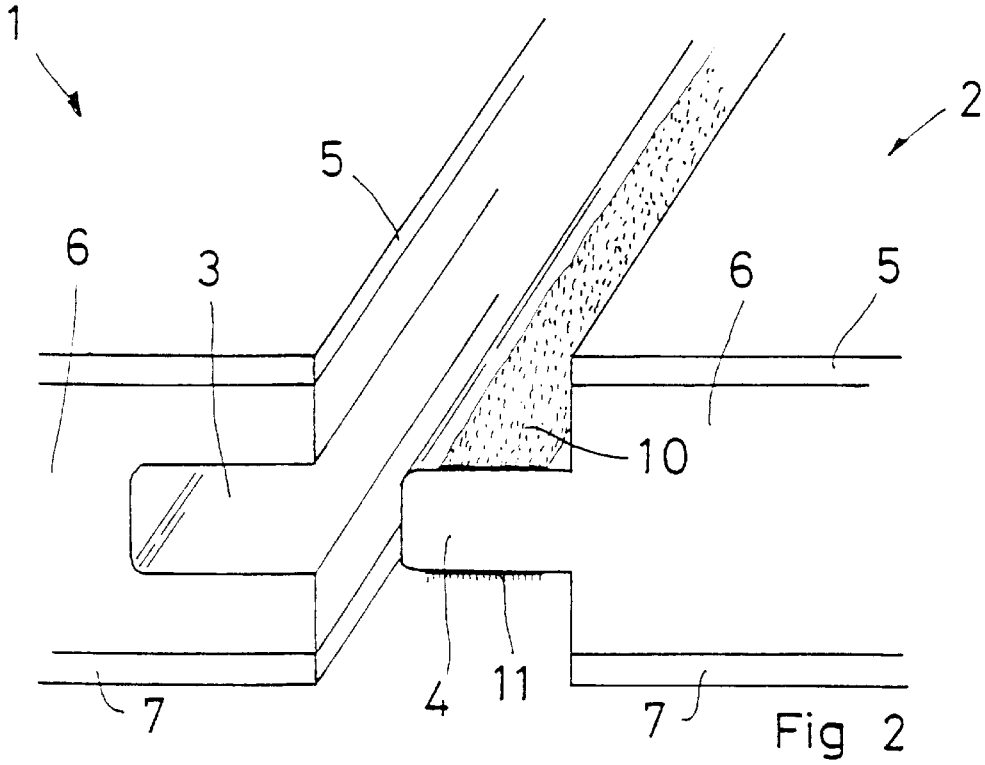
FIG. 2 is a view corresponding to that of FIG. 1 of a second embodiment of the present invention.

FIG. 2 shows a relatively similar embodiment in which, however, the tongue 4 is provided with flocks 10 and 11 on its upper and lower sides, respectively.

In the embodiment according to FIG. 2, the tongue 4 may suitably be of slightly lesser thickness in relation to the width of the groove 3 than was the case in the embodiment according to FIG. 1.

Figure 3:
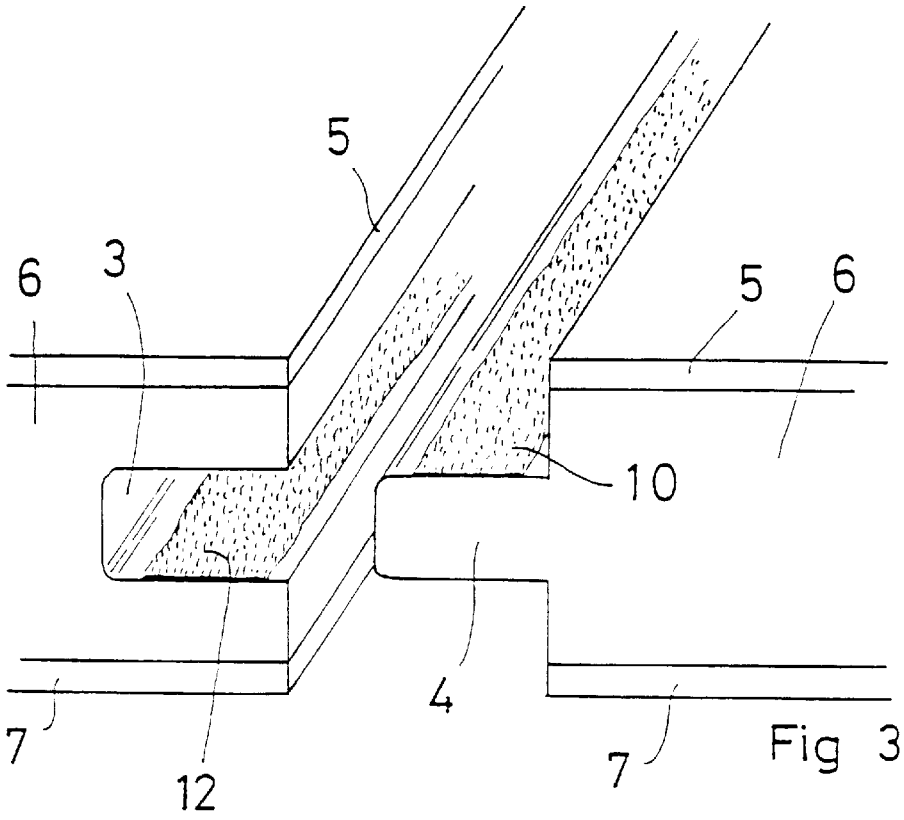
FIG. 3 is a view corresponding to that of FIG. 1 of a third embodiment of the present invention.

In FIG. 3, use is made of a flock 10 on the upper side of the tongue 4 and a flock 12 on the lower defining surface of the groove 3. In this embodiment, the fit between the tongue and the groove should correspond to that which applied in the embodiment according to FIG. 2.

Figure 4:
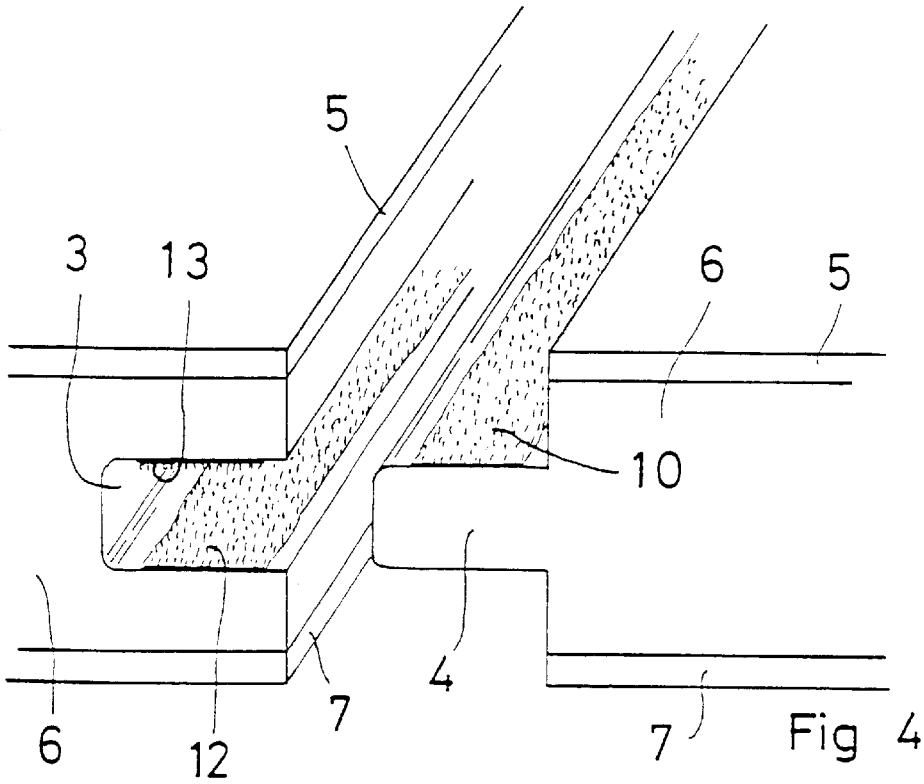
FIG. 4 is a view corresponding to that of FIG. 1 of a fourth embodiment of the present invention.

FIG. 4 shows an embodiment in which the tongue 4 is provided with a flock 10 and in which, in addition, the groove 3 is provided with flocks 12 and 13 on its underside and upper side, respectively. The fit between the tongue and groove may possibly be slightly looser than was the case in the embodiment according to FIG. 3.

Figure 5:
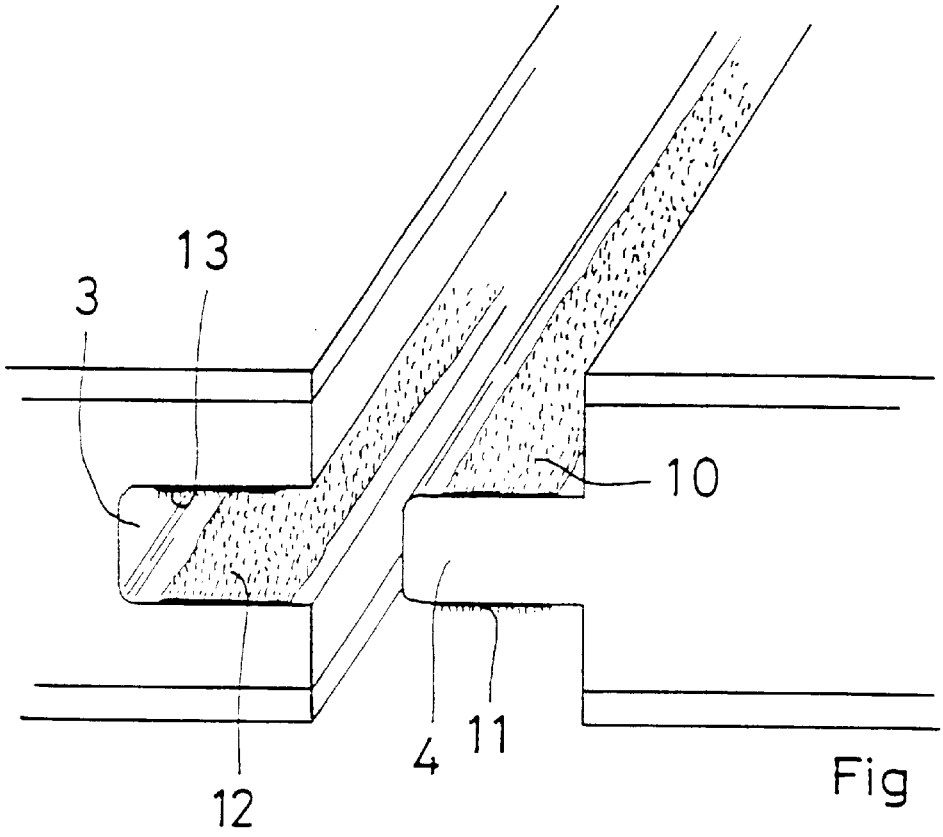
FIG. 5 is a view corresponding to that of FIG. 1 of a fifth embodiment of the present invention.

FIG. 5 shows an embodiment in which the upper and lower sides of the tongue 4 are provided with flocks 10 and 11. Correspondingly, the groove 3 also has flocks 12 and 13 on the under and upper sides, respectively.

As an alternative to applying the base 8 direct to the defining surfaces of the tongue 4 or the groove 3, it may be appropriate to apply the base to a self-adhesive foil or carrier which is provided with the flock fiber. The self-adhesive carrier may then be clipped or cut to suitable strips which are applied to the intended surfaces on the tongue or groove. This embodiment would appear to be particularly advantageous in the application of the flocks 12 and 13 interiorly in the groove 3.

The present invention may be further modified without departing from the spirit and scope of the appended claims.

What is claimed is:

1. A system for tongue and groove jointing of adjacent pieces of flooring material, wherein at least one opposing surface on the tongues and the grooves of the pieces is provided with a flocked surface portion.

2. The system as claimed in claim 1, wherein the flocked surface portion is disposed on at least one of an upper and a lower side of the tongues.

3. The system as claimed in claim 1, wherein the flocked surface portion is disposed on both an upper and a lower side of the tongues.

4. The system as claimed in claim 1, wherein the flocked surface portion is disposed on at least one of an upper and a lower side of the grooves.

5. The system as claimed in claim 1, wherein the flocked surface portion is disposed on both an upper and a lower side of the grooves.

6. The system as claimed in claim 1, wherein the flocked surface portion extends along at least one of the tongues and the grooves and covers substantially the entirety of their length.

7. The system as claimed in claim 1, wherein the flocked surface portion has a fiber length which exceeds the difference between the width of the grooves and the thickness of the tongues.

8. The system as claimed in claim 1, wherein unflocked surface portions in the grooves and the tongues display a roughened, raised or uneven surface structure.

9. A flooring material composed of a number of smaller pieces which have grooves and tongues, wherein at least one surface on a groove or a tongue on two united pieces is a flocked surface for holding together the groove and the tongue.

10. A system for joining a first and a second piece of flooring materials, comprising:

a groove, defined at an edge of said first piece of flooring material;

a tongue, being defined at an edge of said second piece of flooring material, and being correspondingly engageable with said groove of said first piece of flooring material; and at least one opposing surface of said tongue which opposes at least one opposing surface of said groove being provided with a plurality of substantially straight but deformable pieces of fiber, a first end of said pieces of fiber being fastened to said opposing surface of said tongue, and a second end of said fibers being engaged with said opposing surface of said groove when said tongue and said groove are engaged with one another, so that said first piece and said second piece of flooring materials are held firmly in place by said fibers, said opposing surface of said groove being free of fibers.

11. The system for joining flooring materials according to claim 10, wherein said plurality of fibers are substantially perpendicular to the surface to which they are attached.

12. The system for joining flooring materials according to claim 10, wherein said fibers are bent obliquely backward in the direction of insertion when said tongue and said groove are engaged with one another, so that said fibers firmly engage said opposing surface of said groove.

13. A system for joining a first and a second piece of flooring materials, comprising:

a groove, defined at an edge of said first piece of flooring material;

a tongue, being defined at an edge of said second piece of flooring material, and being correspondingly engageable with said groove of said first piece of flooring material; and at least one opposing surface of said groove which opposes at least one opposing surface of said tongue being provided with a plurality of substantially straight but deformable pieces of fiber, a first end of said pieces of fiber being fastened to said opposing surface of said groove, and a second end of said fibers being engaged with said opposing surface of said tongue when said tongue and said groove are engaged with one another, so that said first piece and said second piece of flooring materials are held firmly in place by said fibers, said opposing surface of said tongue being free of fibers.

14. The system for joining flooring materials according to claim 13, wherein said plurality of fibers are substantially perpendicular to the surface to which they are attached.

15. The system for joining flooring materials according to claim 13, wherein said fibers are bent obliquely backward in the direction of insertion when said tongue and said groove are engaged with one another, so that said fibers firmly engage said opposing surface of said tongue.

16. A system for joining a first and a second piece of flooring materials, comprising:

a groove, defined at an edge of said first piece of flooring material;

a tongue, being defined at an edge of said second piece of flooring material, and being correspondingly engageable with said groove of said first piece of flooring material; and at least one opposing surface of said groove, and at least one corresponding opposing surface of said tongue, being provided with a plurality of substantially straight but deformable pieces of fiber, a first end of said pieces of fiber being fastened to one of said surfaces, and a second end of said fibers being engaged with said fibers of said other opposing surface when said tongue and said groove are engaged with one another, so that said first piece and said second piece of flooring materials are held firmly in place by said fibers.

17. The system for joining flooring materials according to claim 16, wherein said plurality of fibers are substantially perpendicular to the surface to which they are attached.

18. The system for joining flooring materials according to claim 16, wherein said fibers are bent obliquely backward in the direction of insertion when said tongue and said groove are engaged with one another, so that said fibers firmly engage said fibers of said opposing surface.

19. A system for joining a first and a second piece of flooring materials, comprising:

a groove, defined at an edge of said first piece of flooring material;

a tongue, being defined at an edge of said second piece of flooring material, and being correspondingly engageable with said groove of said first piece of flooring material; and retaining means, for retaining said tongue in said groove, said retaining means including a plurality of substantially straight but deformable pieces of fiber, said pieces of fiber being fastened to at least one opposing surface of said tongue and said groove while being engaged with the other opposing surface of said tongue and said groove.

20. The system according to claim 19, wherein said other opposing surface engaged with said opposing surface having a plurality of fibers thereon is unflocked.

21. The system according to claim 19, wherein said pieces of fiber are in a deformed state while being engaged with said other of said tongue and said groove.

22. The system according to claim 19, wherein said pieces of fiber are fastened to a surface of said groove.

23. The system according to claim 19, wherein said pieces of fiber are fastened to a surface of said tongue.

24. The system according to claim 19, wherein said pieces of fiber are oriented transversely in relation to a surface to which they are fastened.

25. The system according to claim 19, wherein said pieces of fiber have substantially the same length.

26. The system according to claim 19, wherein each of said opposing surfaces has a plurality of substantially straight but deformable pieces of fiber thereon, and said plurality of fibers of each opposing surface engages said plurality of fibers of said other opposing surface.

27. The system according to claim 19, wherein said pieces of fiber are applied by a flocking process, which comprises:

applying an adhesive base;

electrostatically charging the pieces of fiber; and, applying said pieces of fiber to said adhesive base, wherein, as a result of the electrostatic charging of the pieces of fiber with the same polarity of all fibers, the fibers repel one another and assume a position such that they will be approximately at right angles to the substrate.

* * * * *